US005375264A

United States Patent [19]

Arena

[11] Patent Number: 5,375,264

[45] Date of Patent: Dec. 27, 1994

[54] ADJUSTABLE SIZE CAP WITH AIR PUMP

[76] Inventor: Mario L. Arena, 361 Franklin Ave., Hewlett, N.Y. 11557

[21] Appl. No.: 944,533

[22] Filed: Sep. 14, 1992

Related U.S. Application Data

[63] Continuation-in-part of Ser. No. 801,863, Dec. 3, 1991, abandoned.

[51] Int. Cl.[5] ..... A42B 1/22

[52] U.S. Cl. ..... 2/195.2; 2/418; 2/DIG. 10

[58] Field of Search ..... 2/197, DIG. 10, 181, 2/183, 417, 418, DIG. 11, 175.1, 195.1, 195.2, DIG. 3

[56] References Cited

U.S. PATENT DOCUMENTS 606,982 7/1898 Smyth ..... 2/DIG. 10
1,221,473 4/1917 Riley ..... 2/DIG. 10
5,031,246 7/1991 Kronenberger ..... 2/197
5,153,945 10/1992 Kobayashi ..... 2/DIG. 10

FOREIGN PATENT DOCUMENTS 2394260 2/1979 France ..... 2/DIG. 10

*Primary Examiner*—Clifford D. Crowder
*Assistant Examiner*—Diana L. Biefeld
*Attorney, Agent, or Firm*—Galgano & Burke

[57] ABSTRACT

A cap having a head band and a brim. An expandable tube is mounted inside the head band and an air pump is mounted on the brim and connected to the tube. An air release valve is connected to the tube and is mounted on the outside front of the cap. Whereby the cap may be adjusted to different sizes by pumping air into the tube. The pump being an air cushion mounted on the brim of the cap having an entry valve to provide for entry of air to the tube, so that the pump and release valve maybe operated to fit the cap while the cap is on the user's head.

3 Claims, 1 Drawing Sheet

ADJUSTABLE SIZE CAP WITH AIR PUMP

TECHNICAL FIELD

This invention relates to hats and caps and more particularly to adjustable size caps which can be adjusted while the cap is on the user's head. This application is a continuation in part of Ser. No. 801,863, filed Dec. 3, 1991.

BACKGROUND

Light weight caps generally have a size adjustment consisting of two plastic strips which snap together in different positions.

PRIOR ART

U.S. Pat. No. 5,031,246, shows a cap with an air pump mounted on the rear portion of the head band. In the Applicant's device, the air pump is mounted on the brim and a separate release valve is mounted on the front outside of the cap so that the size can be adjusted without taking the cap off, as would be the case with the cited prior patent.

The following Patents show the state of the art.

| | |
|---|---|
| No. 606,982 Smyth | 3,047,879 Spreiregen |
| 1,221,473 Riley | 5,083,320 Halstead |

THE INVENTION

This invention eliminates the prior snap type adjustment and provides an expandable tube inside the head band of the cap and a valve pump connected to the tube so that the cap can be adjusted different sizes by pumping air into the tube.

OBJECTS OF THE INVENTION

A principal object of the invention is to provide new and improved adjustable size caps.

Another object of the invention is to provide new and improved cap having a head band, means to adjust the size comprising: an expandable tube inside the head band and a valve pump connected to the tube, whereby the cap may be adjusted to different sizes by pumping air into the tube.

Another object is to provide in a cap having a head band and a brim, means to adjust the size comprising: an expandable tube inside the head band and an air pump mounted on the brim and connected to the tube, an air release valve connected to the tube and mounted on the outside front of the cap, whereby the cap may be adjusted to different sizes by pumping air into the tube, and the pump being an air cushion mounted on the brim of the cap having an entry valve to provide for entry of air to the tube, so that the pump and release valve may be operated to fit the cap while the cap is on the user's head.

These and other objects of the invention will be apparent from the following specification and drawing, of which:

BEST MODE OF THE INVENTION

Figure 1:
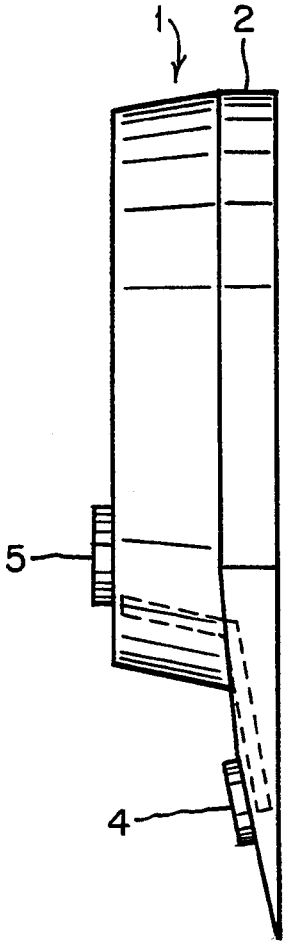
FIG. 1 is a side view of FIG. 2.
Figure 2:
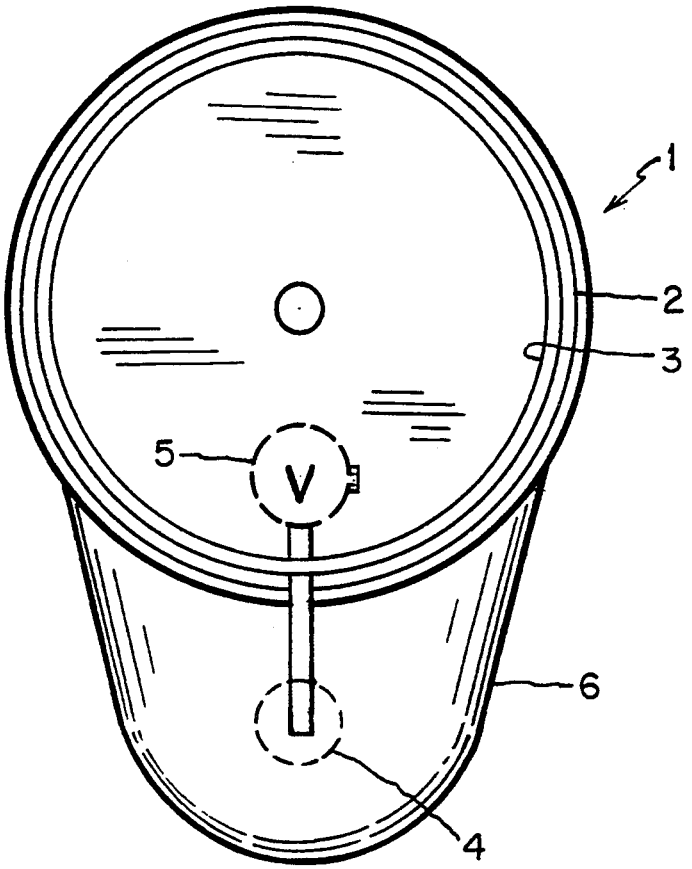
FIG. 2 is a bottom view of an embodiment of the invention.

Referring to the drawings, the cap 1, has a conventional head band 2. A flexible tube 3, is mounted around the inside of the head band 2. The tube 3 is adapted to be expanded to adjust the head size by pumping air into it with the pump 4, which is an air cushion having a valve to provide for entry of air to the tube 3. An air release valve 5, is connected to tube 3, and is mounted on the outside front of the cap. The pump 4 and release valve 5, may be conventional, of the type used in sneakers.

The pump cushion 4, may be mounted on the top of the brim of the cap. The cushion 4, may have a decoration, such as a monogram or other design.

The cap is placed on the user's head and the pump 4, squeezed several times until the fit is comfortable. The release valve 5,is also squeezed several times until the fit is comfortable.

The combination of pump 4, and release valve 5, greatly facilitates the fitting process while the cap is on the user's head. If the cap has to be removed from the user's head to adjust the fit, it makes the fitting less accurate and less convenient and requires much more time.

It is claimed:

1. A cap having an outside front surface, and a brim, means to adjust the size of the cap comprising:

an expandable tube inside the head band and an air pump mounted on the brim and connected to the tube, an air release valve connected to the tube and mounted on the outside front surface of the cap, whereby the cap may be adjusted to different sizes by pumping air into the tube, and the pump being an air cushion mounted on the brim of the cap having an entry valve to provide for entry of air to the tube, so that the pump and release valve may be operated while the cap is rotated back and forth on the wearer's head to fit the cap while the cap is on the wearer's head, both functions being capable of being performed simultaneously by the wearer gripping the brim and the pump with one hand.

2. A cap as in claim 1, where both the pump and the release valve are mounted on the brim of the cap.

3. A cap as in claim 1, where both the pump and the release valve are mounted on and outside surface of the cap.

* * * * *